US005692479A

United States Patent [19]

Ford et al.

[11] Patent Number: 5,692,479

[45] Date of Patent: Dec. 2, 1997

[54] FUEL DELIVERY SYSTEM FOR AN INTERNAL COMBUSTION ENGINE

[75] Inventors: David H. Ford, Canton; Matthew L. Stein, Northville; Daniel J. Lau, Ann Arbor, all of Mich.

[73] Assignee: Ford Motor Company, Dearborn, Mich.

[21] Appl. No.: 556,329

[22] Filed: Nov. 13, 1995

[51] Int. Cl.[6] ..... F02M 37/04

[52] U.S. Cl. ..... 123/514; 123/509; 123/506

[58] Field of Search ..... 123/514, 509, 123/506, 497

[56] References Cited

U.S. PATENT DOCUMENTS

| | | | |
|---|---|---|---|
| 5,070,849 | 12/1991 | Rich | 123/514 |
| 5,133,324 | 7/1992 | Michiaki | 123/514 |
| 5,139,000 | 8/1992 | Sawert | 123/514 |
| 5,195,494 | 3/1993 | Tuckey | 123/514 |
| 5,218,942 | 6/1993 | Coha | 123/514 |
| 5,392,750 | 2/1995 | Laue | 123/509 |
| 5,398,655 | 3/1995 | Tuckey | 123/514 |

FOREIGN PATENT DOCUMENTS

| | | |
|---|---|---|
| 44 02 224 | 7/1995 | Germany . |

*Primary Examiner*—Carl S. Miller
*Attorney, Agent, or Firm*—Neil P. Ferraro

[57] ABSTRACT

A system for delivering fuel to an internal combustion engine wherein excess fuel from a fuel pump is diverted by a pressure regulator to supply low pressure fuel to power a jet pump. The low pressure created by the jet pump entrains fuel from the fuel tank and the combined flow is directed into a reservoir for inlet to the fuel pump.

1 Claim, 4 Drawing Sheets

FUEL DELIVERY SYSTEM FOR AN INTERNAL COMBUSTION ENGINE

The present invention relates to a system for delivering fuel to a internal combustion engine, and more particularly to a supply-side pressure regulator powered jet pump for a returnless fuel system.

BACKGROUND OF THE INVENTION

Traditional automotive fuel delivery systems using a jet pump power the jet pump with fuel flowing either directly from the supply side of the fuel pump or fuel from the engine's fuel rail (return side). Supply side systems place extra demand on the fuel pump to divert a portion of the high pressure fuel from the engine to the jet pump. Return side systems use excess low pressure, high temperature return fuel from the engine to operate the jet pump. The high temperature fuel used in a return side system vaporizes easily and makes jet pump performance difficult to predict and control. The pressure regulator powered jet pump of the present invention does not require additional high pressure fuel pump flow. At the same time, jet pump performance is easily predicted and controlled because engine heat and the associated vapor is not added to the jet pump's supply of fuel. As used herein, "excess fuel" means fuel pumped by the fuel pump that is above engine requirements.

U.S. Pat. No. 5,289,810 discusses a return type fuel delivery system where a control valve is located between the fuel pump and the jet pump. The system according to U.S. Pat. No. 5,289,810 uses high pressure/supply-side fuel to power the jet pump. This is disadvantageous because more power is required to drive the fuel pump thereby potentially decreasing its life. Further, U.S. Pat. No. 5,289,810 requires the use of a greater number of components than the system of the present invention. For example, U.S. Pat. No. 5,289,810 has a check valve between the fuel pump and engine, a valve between the fuel pump and jet pump, and a series pass regulator at the fuel rail. In the present invention, a single pressure regulator is used to supply fuel to both the engine and the jet pump at the desired pressures, thereby resulting in a mechanically controlled returnless fuel system. That is, high pressure fuel is routed to the engine and excess low pressure fuel is routed to the jet pump.

British Patent 559,108 discloses that excess fuel is routed to a jet pump that entrains fuel for increasing the pressure at the inlet of the fuel pump. In the present invention, the fuel exiting the jet pump fills a reservoir within the fuel tank rather than feed the inlet of the fuel pump directly. This is significant in that filling the reservoir reduces the effects of low fuel level on system performance. For example, if the aircraft mentioned in 559,108 was encountering a nose down condition, there is the potential that the jet pump would not receive fuel and that no added fuel will be available at the fuel pump inlet. In the present invention, the output of the jet pump would be delivered to the reservoir which holds fuel for the purpose of assuring fuel availability during vehicle maneuvers. Further, the system disclosed in 559,108 uses a complex arrangement for the pressure regulator. The regulator of 559,108 has a "sense line" (a port used to adjust system pressure). The use of a sense line, by changing pump pressure, adds another variable, in addition to engine demand, in varying jet pump flow and performance. Using the pressure regulator to power the jet pump according to the present invention makes the system easier to predict and control.

Accordingly, an advantage of the present invention is that the fuel delivery system reduces the adverse effects of hot fuel such as vapor generation and efficiency losses by providing a supply side jet pump.

Another advantage of the invention is that jet pump performance is predictable and restart capabilities are improved by using the jet pump to supply fuel to a reservoir.

Yet another advantage of the invention is that less components that are less complex than prior art systems are used thereby resulting in less cost.

Other objects, features and advantages of the present invention will be readily appreciated by the reader of this specification.

SUMMARY OF THE INVENTION

According to the invention, a system for delivering fuel to an internal combustion engine includes a fuel holding means; a reservoir located within the fuel holding means and being in fluid communication with the fuel holding means; and a fuel pump located within the reservoir for pumping fuel from the fuel holding means through a fuel line to the engine. A pressure regulator is disposed between an outlet of the fuel pump and the fuel line. The pressure regulator has an inlet port for communication with the fuel pump, a first outlet port for communication with the fuel line, and a second outlet port for returning excess low pressure fuel to the reservoir. Further, a jet pump is disposed between the second outlet port of the pressure regulator and the reservoir such that the excess low pressure fuel powers the jet pump.

Also, according to the invention, a mechanically controlled returnless fuel delivery system for an internal combustion includes a fuel tank; a reservoir located within the fuel tank and being in fluid communication with the fuel tank; and a fuel pump located within the reservoir for pumping fuel from the fuel tank through a fuel line to the engine via a fuel rail attached to the engine. A pressure regulator is located in the fuel tank and is disposed between an outlet of the fuel pump and the fuel line. The pressure regulator has an inlet port for communication with the fuel pump, a first outlet port for communication with the fuel line and a second outlet port for returning excess low pressure fuel to the reservoir. Further, a jet pump is disposed between the second outlet port of the pressure regulator and the reservoir whereby the excess low pressure fuel enters the jet pump at jet pump inlet such that a low pressure condition exists at an orifice of the jet pump so as to cause fuel from the fuel tank to enter the jet pump, combine with fuel exiting the orifice and enter the reservoir. The size of the orifice is such that the pressure between the second outlet of the pressure regulator and the inlet of the jet pump is less than the fuel pressure in the fuel rail during all engine operating conditions.

Also, according to the invention a method of delivering fuel to an internal combustion engine includes the steps of providing a fuel holding means to hold fuel for consumption by the engine; locating a reservoir within the fuel holding means such that the reservoir is in fluid communication with the fuel holding means; and locating a fuel pump within the reservoir for pumping fuel from the fuel holding means through a fuel line to the engine. The method also includes the steps of disposing a pressure regulator between an outlet of said fuel pump and said fuel line and providing the pressure regulator with an inlet port for communication with the fuel pump, a first outlet port for communication with the fuel line and a second outlet port for returning excess low pressure fuel to the reservoir. Further, the method includes the step of positioning a jet pump between the second outlet port of the pressure regulator and the reservoir such that the excess low pressure fuel powers the jet pump.

BRIEF DESCRIPTION OF THE DRAWING

The invention will now be described, by way of example, with reference to the accompanying drawings, in which.

DETAILED DESCRIPTION OF THE INVENTION

Figure 1:
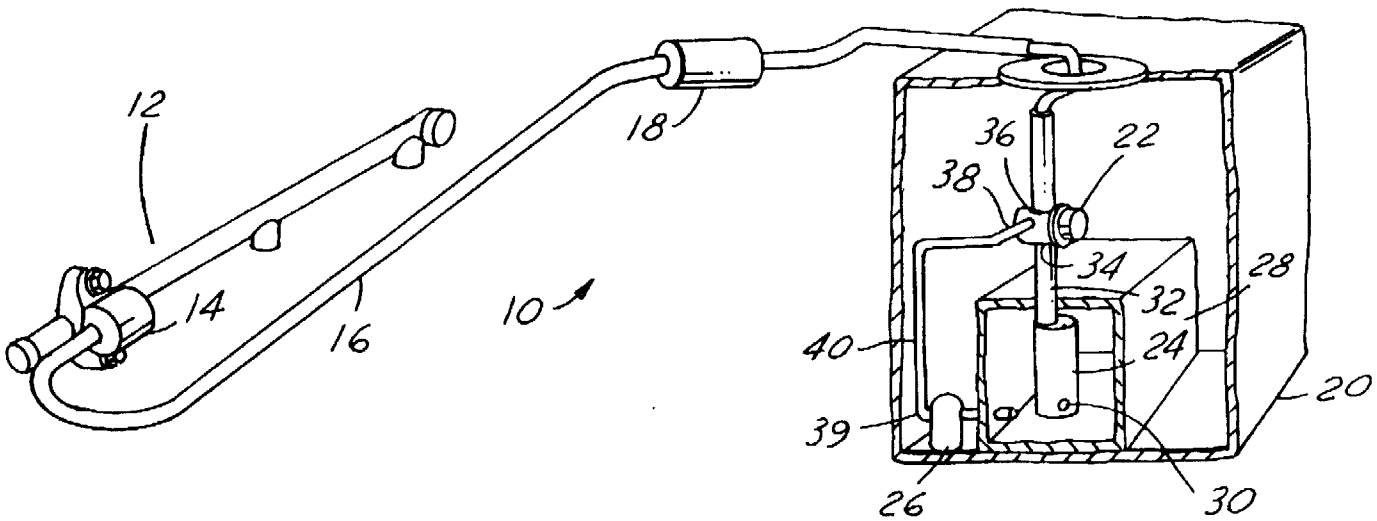
FIG. 1 is a diagrammatic representation of a returnless fuel system incorporating a pressure regulator powered jet pump according to the present invention.
Figure 2:
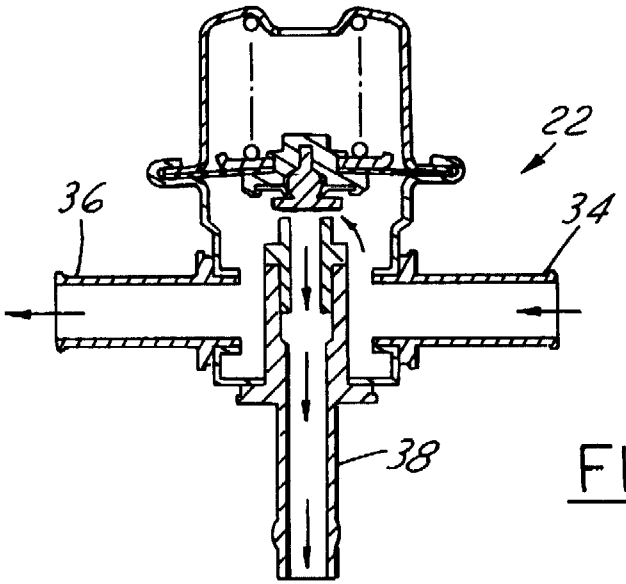
FIG. 2 is a cross sectional view of a pressure regulator according to the present invention.

FIG. 1 shows a mechanically controlled returnless fuel system 10 having fuel rail 12, fuel line 16 coupled to fuel rail 12 via coupling 14, fuel filter 18, and a fuel holding means such as fuel tank 20. In this example, fuel tank 20 houses the components of the present invention, namely pressure regulator 22, fuel pump 24, jet pump 26, and reservoir 28. Fuel is delivered into fuel tank 20 by a fill tube (not shown) such that as the fluid level in the tank rises, fuel also fills reservoir 28 through an access port (not shown). Fuel pump 24, upon demand from the engine (not shown), pumps fuel from fuel tank 20 through fuel line 16, and into high pressure fuel rail 12 for distribution to the fuel injectors (not shown). In a conventional return-line fuel delivery system, the output of the fuel pump 24 remains relatively constant regardless of the demand required by the engine. Thus, any fuel not used for combustion is returned to the fuel tank by the return fuel line. As previously discussed, upon returning to the fuel tank, the fuel is at an elevated temperature and thus vaporizes easily, making jet pump performance difficult to predict and control. However, the present invention is for use in a mechanical returnless fuel delivery system. Thus, fuel within reservoir 28 enters fuel pump 24 through inlet 30 where it is pumped up to a higher pressure and exits outlet 32 of fuel pump 24. The fuel then enters pressure regulator 22 through inlet 34 (see also FIG. 2) and exits pressure regulator 22 through outlet 36. The primary function of pressure regulator 22 is to control the outlet pressure of the fuel entering the fuel line 16 as well as supply pressure powering jet pump 26.

Figure 4:
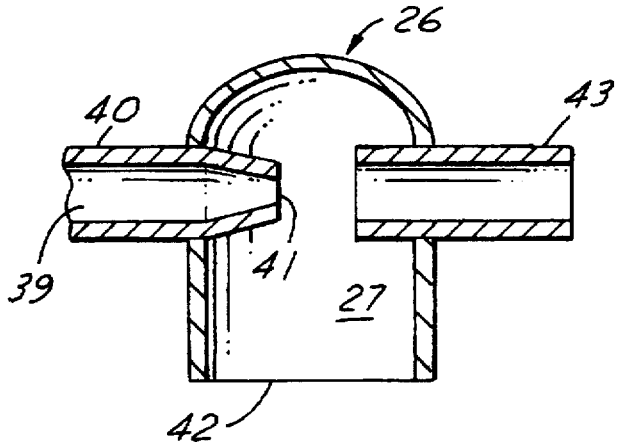

Pressure regulator 22 has a second outlet port 38 such that excess fuel not required by fuel rail 12 is routed to jet pump 26 at low pressure via fuel line 40. Low pressure created at orifice 41 (see FIG. 4) of jet pump 26 entrains fuel within fuel tank 20 near opening 42. The combined fuel (fuel from jet pump 26 and fuel entrained from fuel tank 20) is then returned to fuel pump reservoir 28 via outlet 43 for supplying fuel pump 24 That is, excess fuel exiting jet pump 26 at orifice 41 creates a low pressure area in jet pump housing 27 so as to cause fuel within fuel tank 20 to enter jet pump housing 27 through opening 42. The combined fuel the enters fuel pump reservoir 28, via outlet 43, thereby supplying the appropriate volume of fuel to the fuel pump 24. Thus, as previously stated, there is no high temperature fuel supplying the jet pump nor is there extra demand placed on fuel pump 24 to supply high pressure fuel to both the engine and jet pump 26. In the present invention, the fuel exiting jet pump 26 fills reservoir 28 within fuel tank 20 rather than feed inlet 30 of fuel pump 24 directly. This is significant in that filling reservoir 28 reduces the effects of low fuel level on system performance. That is, reservoir 28 holds fuel for the purpose of assuring fuel availability during vehicle maneuvers.

Figure 3A:
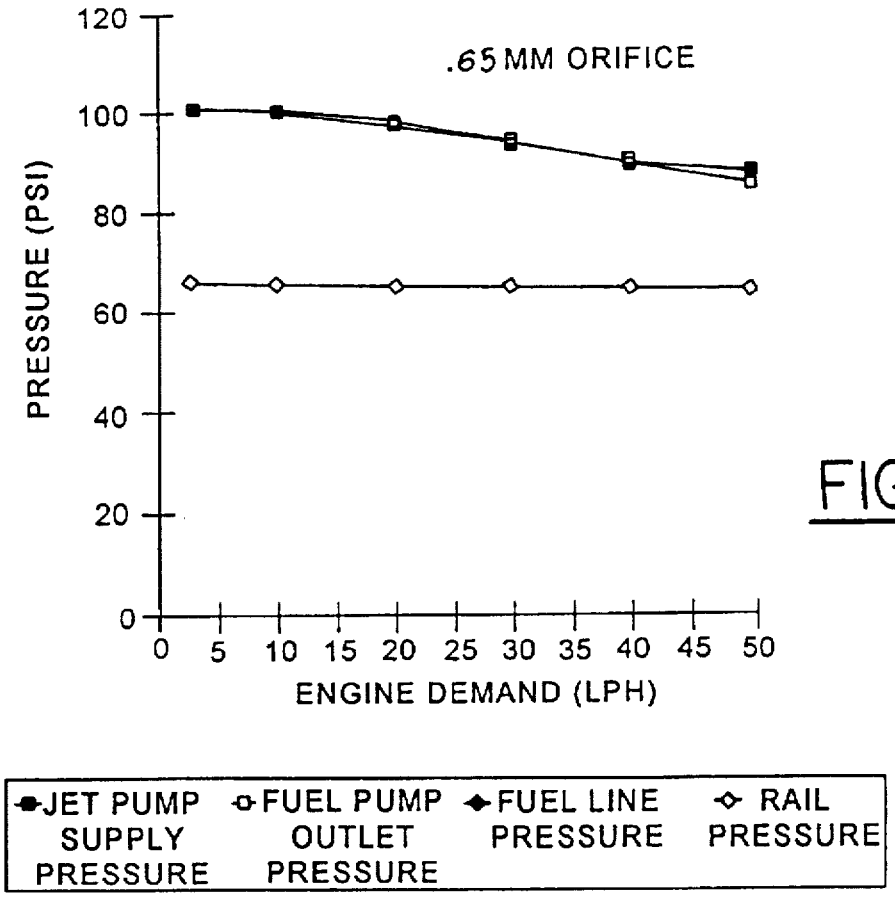
FIGS. 3*a*–3*e* are graphs displaying results from tests performed to determine optimum jet pump orifice size; and, FIG. 4 is a cross sectional view of a jet pump according to the present invention.
Figure 3B:
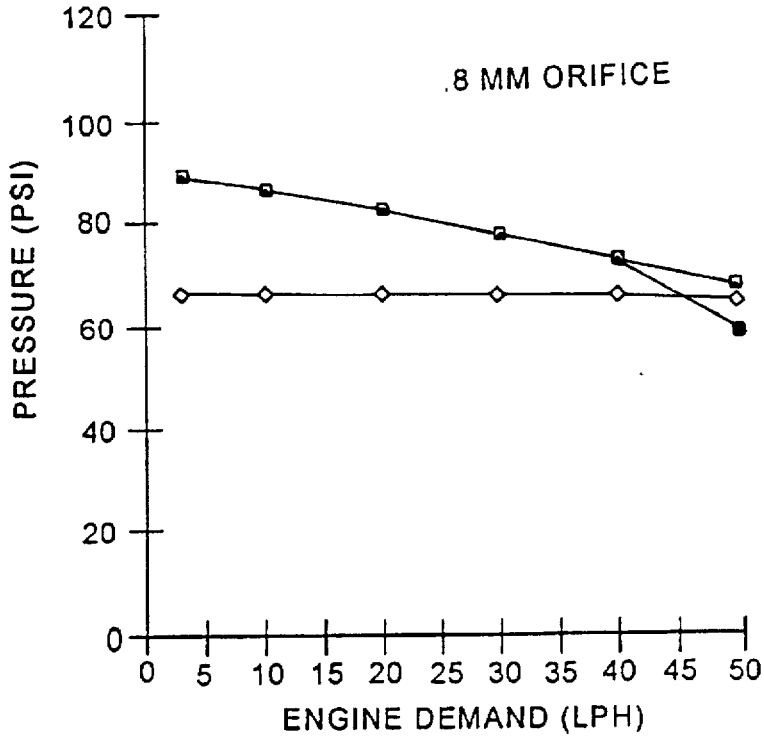
Figure 3C:
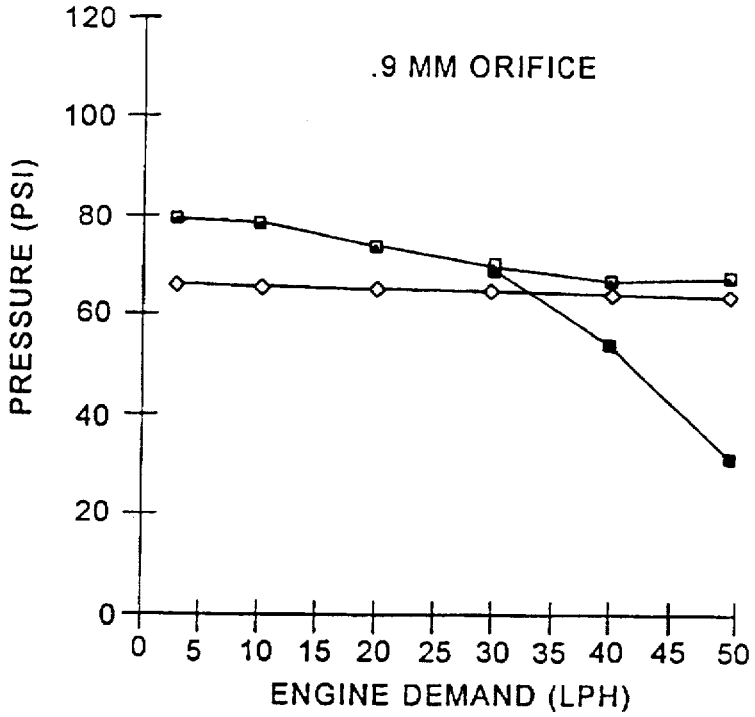
Figure 3D:
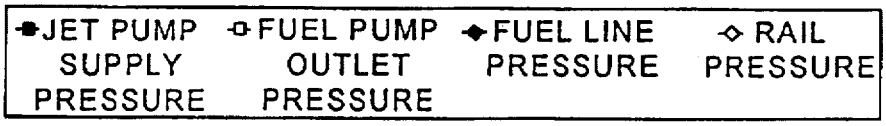
Figure 3D:
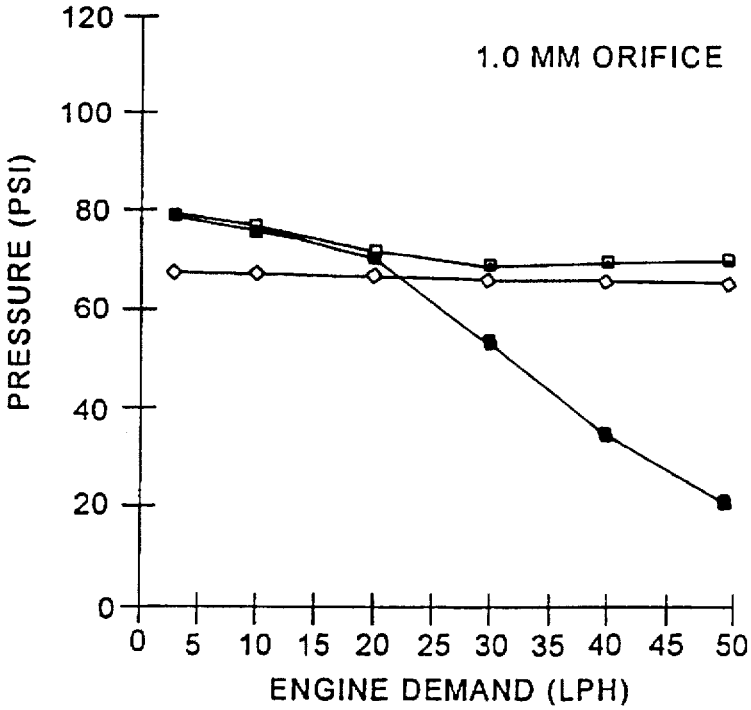
Figure 3E:
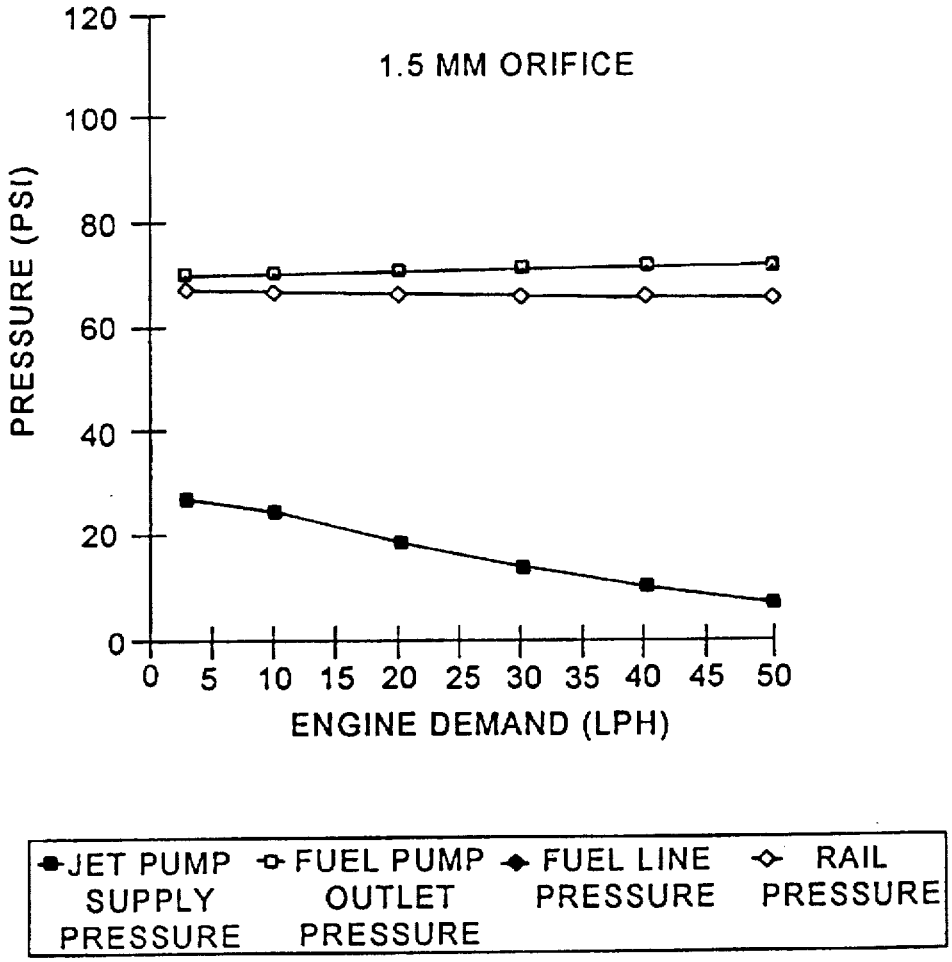

In order to determine the size of orifice 41 required to keep reservoir 28 full and not impact the functionality of pressure regulator 22, a test was performed with the results depicted in FIGS. 3*a*–3*e*. In this test, a 4.0 liter engine was used. The constraints placed on the test when the system according to the present invention functions as desired were: 1) regulator performance must not be affected by the back pressure created by the jet pump; 2) fuel rail pressure (65 psi nominal) must be maintained at all engine demands; 3) reservoir level must be maintained at all engine demands; and, 4) fuel pump outlet and fuel line pressures must be maintained at pressure regulator pressure (70 psi nominal). Other test parameters included maintaining the fuel at 75° F. and operating the fuel pump at 12.5 volts. The various graphs depicted in FIGS. 3*a*–3*e* show jet pump supply pressure in fuel line 40 (pressure between outlet 38 of pressure regulator 22 and inlet 39 of jet pump 26), fuel pump outlet pressure in fuel line 32, fuel line pressure in fuel line 16, and fuel rail pressure in fuel rail 12, versus engine operating condition (demand)—measured in liters of fuel per hour (1 ph)—for different sizes of orifice 41. In particular, FIG. 3*a* shows pressure versus engine demand using a jet pump having a 0.65 mm orifice size; FIG. 3*b* shows pressure versus engine demand using a jet pump having a 0.8 mm orifice size; FIG. 3*c* shows pressure versus engine demand using a 0.9 mm orifice size; FIG. 3*d* shows pressure versus engine demand using a jet pump having a 1.0 mm orifice size; and, FIG. 3*e* shows pressure versus engine demand using a jet pump having a 1.5 mm orifice size. The goal of the test was to determine the jet pump orifice size that would provide the lowest jet pump supply pressure in fuel line 40 during all engine operating conditions for a desired engine. That is, the size of orifice 41 is dependent upon a particular engine. For example, as can be seen from FIGS. 3*a*–3*e*, a jet pump having an orifice size of 1.5 mm is desirable for a 4.0 liter engine because the jet pump supply pressure was low during all engine operating conditions. In this example, the jet pump supply pressure is less than about 30 psi. during all engine operating conditions. Thus, a supply-side pressure regulator powered jet pump having an appropriately sized orifice provides the low pressure desired to power the jet pump. The low jet pump supply pressure allows fuel pump 24 to be smaller thus requiring less power to operate and increasing fuel economy.

While the best mode in carrying out the invention has been described in detail, those having ordinary skilled in the art to which this invention relates will recognize various alternative designs and embodiments, including those mentioned above, in practicing the invention that has been defined by the following claims.

We claim:

1. A mechanically controlled returnless fuel delivery system for an internal combustion engine, the system comprising:

a fuel tank;

a reservoir located within said tank and being in fluid communication with said fuel tank;

a fuel pump located within said reservoir for pumping fuel from said fuel tank to said engine;

a fuel line connected to said fuel pump for transferring fuel from said fuel tank to said engine;

a fuel rail being in fluid communication between said fuel line and said engine;

a jet pump having an inlet and an orifice having a size of about 1.5 mm, with said jet pump communicating with said fuel pump such that excess fuel pumped by said fuel pump powers said jet pump whereby said excess fuel enters said jet pump at said jet pump inlet thereby creating a low pressure condition at said orifice of said jet pump so as to cause fuel from said fuel tank to enter said jet pump, combine with fuel exiting said orifice and enter said reservoir; and, a pressure regulator located in said fuel tank and disposed between an outlet of said fuel pump, said fuel line, and said inlet of said jet pump, with said pressure regulator regulating fuel to both said engine and said jet pump, with said pressure regulator comprising:

a first chamber being under approximately atmospheric pressure, with said first chamber including a single spring;

a second chamber having an inlet port communicating with said fuel pump, a first outlet port communicating with said fuel line and a second outlet port communicating with said inlet of said jet pump, with said inlet port, said first outlet port and said second outlet port communicating exclusively with said second chamber such that fuel flows from said fuel pump exclusively through said second chamber to supply fuel to both said engine and said jet pump without flowing through said first chamber;

a single diaphragm defining the boundary between said first and second chambers, with said spring biasing said diaphragm so as to regulate fuel flow from said inlet port to said first outlet port and from said inlet port to said second outlet port;

wherein the fuel pressure between said second outlet of said pressure regulator and said inlet of said jet pump is between 0 psi and 40 psi and wherein the fuel pressure in said fuel rail is between 60 psi and 80 psi during all engine operating conditions.

* * * * *